United States Patent [19]

Bersch et al.

[11] Patent Number: 4,855,021

[45] Date of Patent: Aug. 8, 1989

[54] METHOD FOR ELECTROPLATING A STEEL STRIP WITH A COATING METAL, IN PARTICULAR ZINC OR A ZINC-CONTAINING ALLOY

[75] Inventors: Horst Bersch, Neuwied; Karl-Heinz Kilian, Andernach; Hans U. Weigel, Dernbach, all of Fed. Rep. of Germany

[73] Assignee: Rasselstein AG, Neuweld, Fed. Rep. of Germany

[21] Appl. No.: 222,187

[22] Filed: Jul. 21, 1988

[30] Foreign Application Priority Data

Aug. 15, 1987 [DE] Fed. Rep. of Germany ..... 3727246

[51] Int. Cl.[4] ..... C25D 7/06

[52] U.S. Cl. ..... 204/28

[58] Field of Search ..... 204/15, 28, 146

[56] References Cited

U.S. PATENT DOCUMENTS 3,989,604 11/1976 Austin ..... 204/28

4,397,727 8/1983 Degen ..... 204/206

FOREIGN PATENT DOCUMENTS 0092342 10/1983 European Pat. Off. .

3209451 3/1983 Fed. Rep. of Germany .

*Primary Examiner*—T. M. Tufariello

*Attorney, Agent, or Firm*—Flynn, Thiel, Boutell & Tanis

[57] ABSTRACT

In a method for electroplating a steel strip with a coating metal, in particular, zinc or a zinc-containing alloy, a thin protective layer consisting of the coating metal is temporarily electrodeposited on one side of the steel strip. After complete coating of the other side, this protective layer is completely or essentially removed in a stripping step in which the coated steel strip as the anode is moved through a stripping electrolyte. The stripping electrolyte contains a sequestering agent, advantageously sodium gluconate.

19 Claims, No Drawings

METHOD FOR ELECTROPLATING A STEEL STRIP WITH A COATING METAL, IN PARTICULAR ZINC OR A ZINC-CONTAINING ALLOY

The invention concerns a method for electroplating a steel strip with a coating metal, in particular zinc or a zinc-containing alloy, wherein a thin protective layer consisting of the coating metal is temporarily electrodeposited on one side of the steel strip and, after the complete coating of the other side, this protective layer is either removed completely, or a thin residual coating is left in a stripping step in which the coated steel strip, as the anode is moved through a stripping electrolyte.

In the automobile industry, steel sheets electroplated on one side are used for certain exterior components of the bodywork. The coated side, which usually comprises a zinc-containing metal coating, is directed towards the inner side of the bodywork, while the uncoated outer side is sprayed. However, as paint displays different properties on zinc-containing coatings than on a steel surface, it is important that the uncoated side be free from electrolytic deposits so that, when the paint system is applied, it behaves in the same way as an uncoated sheet. During the normal passage of the steel strip through an electrolytic finishing plant for the purpose of plating the strip on one side, it is unavoidable that the side which is not to be coated comes into contact with the electrolyte. In the process, due to chemical reactions of the electrolyte with the sheet surface, surface changes, which become noticeable in the form of spots, may arise. Particularly in the case of zinc-nickel electrolytes, electroless deposition of nickel alloys leads to dark discoloration. Also, etching of the strip surface on the side which is not to be coated may occur. Furthermore, it was found that when a steel strip is coated on one side, in the immediate vicinity of the longitudinal edges, even on the side which is not to be coated, the coating metal is deposited in the form of narrow strips, which is referred to as so-called "overlap." In the automobile industry, there is the requirement that even this overlap of the edges should not exist. There are of course methods for electroplating a steel strip on one side, in which the steel strip is not fully immersed in an electrolyte such as the electrolyte being only sprayed onto the side to be coated (West German Pat. No. 32 09 451). With methods of this kind, too, individual drops of liquid, and possible overlap, on the side which is not to be coated cannot be avoided reliably.

With one known method of the kind mentioned hereinbefore (U.S. Pat. No. 3,989,604), a steel strip is first electroplated on both sides with zinc, preferably in such a way that the thickness of the layer on one side is thinner than on the other side. This type of coating is referred to as "differential coating." The thinner layer on one side should be 3,000–45,000 mg/m$^2$ (0.01 ounce/ft$^2$–0.15 ounce/ft$^2$). The differentially coated steel strip is then guided into a tank which contains an electrolyte consisting of a relatively weak acid solution, particularly, an aqueous solution of zinc sulphate and sulphuric acid, with a pH value of 1–4 and a temperature of 49°–66° C. (120°–150° F.). In this tank, the steel strip is passed through between a cathode and an anode at current densities of 22–110 A/dm$^2$ (200–1000 amps/ft$^2$), preferably at 55 A/dm$^2$ (500 amps/ft$^2$). Here, the zinc is electrolytically removed from the one side of the steel strip coated with a thin zinc layer, and at the same time the thickness of the zinc layer on the other side is increased. At current densities below 55 A/dm$^2$, however, a metallic zinc layer remains on the one side in the form of a loose black coating which must be removed by brushing. This known method is uneconomical since, for removal of the relatively thick protective layer from the one side, very high current densities have to be used in order to be able to perform removal of the coating in technically justifiable times. At current densities below 55 A/dm$^2$, it is necessary to brush off the black coating, which remains during stripping, as an additional operation, in which case there is a risk of the steel surface being damaged by the brushes. Moreover, the known method can be applied only to steel strips coated with pure zinc. In the case of electrodeposition of zinc-nickel and zinc-iron alloys, during removal of the coating from one side and simultaneous deposition on the other side, uncontrollable and uncontainable mixed phases of zinc and nickel or zinc and iron would be deposited on to the other side which, in the automobile industry, could lead to non-uniform phosphatisation or priming behaviour.

In order to keep the uncoated side of a steel strip, which is coated on one side, free from undesirable impurities, a similar method has been proposed, in which a protective layer of the coating metal is temporarily applied electrolytically to the side which is not to be coated, and electrolytically removed again later (European patent application No. 092 342). With this known method, the protective layer, temporarily deposited on the steel strip, is removed by means of a stripping electrolyte which contains at least one phosphate selected from the group consisting of alkali metal phosphates and ammonium phosphates. When this stripping electrolyte is used, however, a thin phosphate layer is formed on the side which is not to be coated. This thin phosphate layer is undesirable to many automobile manufacturers, as it impairs the subsequent application of a phosphate coating by the automobile manufacturer.

It is the object of this invention to indicate a method for electroplating a steel strip with a coating metal, in particular zinc or a zinc-containing alloy of the kind mentioned hereinbefore, which allows for the economic manufacture of a coated steel strip, in which one side is uncoated or provided with a thin residual coating but is otherwise free from impurities as well as from phosphate, so that it behaves like an uncoated steel surface with respect to subsequent spraying or phosphatisation.

According to present invention, this object is achieved by the deposition of the protective layer being carried out at current densities of 1–30 A/dm$^2$ an a layer thickness of 20–100 mg/m$^2$, being and formed the subsequent stripping of the protective layer is carried out in a stripping electrolyte containing an organic sequestering agent, at current densities of 5–30 A/dm$^2$.

Application of the protective layer prevents the side which is and have no coating, or only a residual coating layer, from undergoing undefined changes such as metal deposition or etching due to splashes or other contact with the electrolyte during the electroplating of the other side. As the protective layer is applied in a relatively low thickness, after complete coating of the other side, it can also be removed again with relatively little expenditure of energy. The choice of the stripping electrolyte is of critical importance here. The metals which are anodically stripped in the stripping electrolyte are coordinated so that recoating with these metals of the side to be stripped, is prevented. Furthermore, due to the alkalinity of the stripping electrolyte, the steel surface is passivated so that the quantity of iron dissolved anodically is small. This means that the sequestering agent is not consumed by iron ions. The stripping electrolyte according to the invention further has the advantage that it does not react with the steel surface to form an insoluble compound the adheres to the steel surface. Thus, no phosphate coating or the like is formed. The "stripped" side, after the stripping process, thus behaves like a normal uncoated steel surface during subsequent technical use, e.g. when applying paint or phosphatising, which is of critical importance for subsequent satisfactory phosphatisation and spraying. Also, during the stripping process, any "overlap" is eliminated. Preferably, by means of a special stripping electrolyte containing a sequestering agent and observing other conditions of electrochemical stripping, the process can be controlled in such a way that a thin residual coating of up to 50 mg/m$^2$ remains on one side of the strip. This thin residual coating does not in any way interfere with subsequent phosphatisation and spraying such as is carried out, e.g., by the automobile manufacturer. It does, however, offer adequate temporary protection against corrosion until this phosphatisation is carried out.

In the stripping electrolyte are preferably used, as sequestering agents, aqueous solutions of alkali metal salts, particularly sodium salts, of one or more of the following acids:

aldonic acids
diethylene triamine pentaacetic acid
ethylene diamine tetraacetic acid
hydroxycarboxylic acids
nitrilotriacetic acid
polycarboxylic acids.

In order to increase the conductivity of the electrolyte, a substance which increases conductivity can be added to it. Sodium sulphate is particularly suitable for this.

The pH value of the electrolyte is to be adjusted so that the sequestering action of the electrolyte is fully preserved, but there is no or only slight electrolytic etching of the steel surface. For this reason, advantageously, the pH value of the electrolyte is adjusted to over 8, preferably 8–10.

So that the temporarily applied protective layer can be removed again without problems during stripping, it is advantageous if the thickness of the protective layer is approximately 20–30 mg/m$^2$. In this case, it must be taken into account that during coating of the other side, which has previously been provided with the protective layer, due to electroless deposition, there may also arise changes to the protective layer, leading to an increase in thickness of the layer, at least in some areas of the strip. After complete coating of the other side, therefore, there may be on the side with the protective layer, a layer thickness which is greater than the thickness of the originally applied protective layer.

Electrodeposition of the protective layer advantageously takes place simultaneously with the commencement of electrodeposition on the other side in the same coating electrolyte.

Furthermore it has proved advantageous if, before electrodeposition of the protective layer, short-term electroless wetting of the steel strip with the coating electrolyte is carried out.

The temperature of the stripping electrolyte should be maintained at about 30°–70° C. Stripping can then be carried out within less than 10 sec.

In order to increase the useful life of the stripping electrolyte, it is possible to carry out regeneration with acid cation exchangers.

Examples of compositions of suitable stripping electrolytes are given below:

EXAMPLE 1

| | |
|---|---|
| Sodium salt of a polycarboxylic acid preferably | 10–20 g/l |
| Sodium sulphate preferably | 5–25 g/l |
| Current density | 10 A/dm$^2$ |
| Temperature | 30° C. |
| Time | 2 sec |

EXAMPLE 2

| | |
|---|---|
| Sodium salt of 2,3,4,5,6-pentahydroxycarboxylic acid (D) (dextronic acid) preferably | 20–100 g/l |
| Sodium Sulphate preferably | 5–25 g/l |
| Curret density | 10 A/dm$^2$ |
| Temperature | 30° C. |
| Time | 2 sec |

EXAMPLE 3

| | |
|---|---|
| Sodium salt of nitrilotriacetic acid Titriplex ® I preferably | 10–50 g/l |
| Sodium sulphate preferably | 5–25 g/l |
| Current density | 10 A/dm$^2$ |
| Temperature | 30° C. |
| Time | 2 sec |

The zinc, nickel and iron content of the complex solution plays no part in the stripping process. It is a consequence of stripping. Nevertheless, the zinc, nickel and iron concentration in the stripping electrolyte must not increase to such an extent that all the complexing organic molecules are consumed, otherwise, recoating can no longer be prevented.

The following impurities of the stripping electrolyte are permitted when stripping a sheet coated with zinc and nickel:

| | |
|---|---|
| zinc | maximum 1,000 mg/l |
| nickel | maximum 2,000 mg/l |
| iron | maximum 500 mg/l |

As the stripping process is carried out at relatively low current densities, any possible stripping at the edges of the other side as well (overlap of the edges) is negligible. If this overlap is to be avoided completely, electrode assemblies such as have been developed for coating on one side may also be used for the stripping process. Electrodes of this kind are described in West German Pat. No. 32 09 451.

It has turned out that the method according to the invention is particularly suitable for electroplating a steel strip on one side with zinc or a zinc-nickel alloy.

We claim:

1. In a method for electrodepositing a single-sided metal coating on a steel strip wherein a protective layer of the metal to be coated is first deposited on one side of the steel strip and, after the application of the metal coating to the other side of the steel strip, the steel strip is made anodic and contacted with a stripping electrolyte in order to remove said protective layer from said one side, the improvement comprising the protective layer being deposited in a thickness of 20–100 mg/m$^2$ and at a current density of from 1–30 A/dm$^2$ and the stripping of said protective layer being carried out in a stripping electrolyte having an organic sequestering agent and at a current density of 5–30 A/dm$^2$.

2. The method according to claim 1 characterised in that in the stripping electrolyte are used, as sequestering agents, aqueous solutions of alkali metal salts, of one or more of the following acids;
aldonic acids
diethylene triamine pentaacetic acid
ethylene diamine tetraacetic acid
hydroxycarboxylic acids
nitrilotriacetic acid
polycarboxylic acids.

3. The method according to claim 2, characterised in that the sodium salt of a polycarboxylic acid is used as the sequestering agent in the stripping electroyte.

4. The method according to claim 2, characterised in that the stripping electrolyte contains a sodium salt of dextronic acid as the sequestering agent.

5. The method according to claim 2, characterised in that the stripping electrolyte contains a sodium salt of nitrilotriacetic acid as the sequestering agent.

6. The method according to claim 1, characterised in that the stripping electrolyte contains a substance which increases its conductivity.

7. The method according to claim 6, characterised in that sodium sulphate is used as said substance.

8. The method according to claim 1, characterised in that the pH value in the stripping electrolyte is adjusted to from 8–10.

9. The method according to claim 1, characterised in that the temperature of the stripping electrolyte is maintained at 30°–70° C.

10. The method according to claim 1, characterised in that said stripping is carried out within 10 sec.

11. The method according to claim 1, characterized in that the protective layer is removed from said one side to such an extent that a residual coating of said protective layer of up to 50 mg/m$^2$ remains.

12. Method according to claim 1, characterised in that electrodeposition of the protective layer is carried out in a layer thickness of 20–30 mg/m$^2$.

13. The method according to claim 1, characterized in that electrodeposition of the protective layer on said one side is carried out simultaneously with the commencement of the electrodeposition of a preliminary coating on said other side in the same coating electrolyte.

14. The method according to claim 1, characterised in that before electrodeposition of the protective layer, short-term electroless wetting of the steel strip with the coating electrolyte is carried out.

15. The method according to claim 1, characterized in that in the stripping electrolytes are used, as sequestering agents, aqueous solutions of sodium salts of one or more acids selected from the group consisting of aldonic acids, diethylene triamine pentaacetic acid, ethylene diamine tetraacetic acid, hydroxycarboxylic acids, nitrilotriacetic acid, and polycarboxylic acids.

16. The method according to claim 1, characterized in that said protective layer is deposited in a thickness of about 20–30 mg/m$^2$.

17. The method according to claim 1, characterized in that said stripping electrolyte is maintained at a temperature of about 30°–70° C.

18. The method according to claim 1, characterized in that said metal to be coated is selected from the group consisting of zinc and zinc alloys.

19. The method according to claim 1, characterized in that said organic sequestering agent is sodium gluconate.

* * * * *

UNITED STATES PATENT AND TRADEMARK OFFICE

CERTIFICATE OF CORRECTION

PATENT NO. : 4 855 021

DATED : August 8, 1989

INVENTOR(S) : Horst BERSCH et al.

It is certified that error appears in the above-identified patent and that said Letters Patent is hereby corrected as shown below:

Column 5, line 16; change ";" to ---:---.

Column 6, line 11; change "is carried" to ---results---.

Column 6, line 12; change "out in a layer" to ---in a protective layer---.

Signed and Sealed this

Twenty-fifth Day of September, 1990

*Attest:*

HARRY F. MANBECK, JR.

*Attesting Officer*

*Commissioner of Patents and Trademarks*